US009133666B2

(12) United States Patent
Lee

(10) Patent No.: US 9,133,666 B2
(45) Date of Patent: Sep. 15, 2015

(54) EXPANDABLE DOWNHOLE TOOL APPARATUS

(76) Inventor: Paul Bernard Lee, Calgary (CA)

( * ) Notice: Subject to any disclaimer, the term of this patent is extended or adjusted under 35 U.S.C. 154(b) by 251 days.

(21) Appl. No.: 13/391,418

(22) PCT Filed: Aug. 20, 2010

(86) PCT No.: PCT/GB2010/051380

§ 371 (c)(1),
(2), (4) Date: Mar. 21, 2012

(87) PCT Pub. No.: WO2011/021048

PCT Pub. Date: Feb. 24, 2011

(65) Prior Publication Data

US 2012/0168229 A1 Jul. 5, 2012

(30) Foreign Application Priority Data

Aug. 21, 2009 (GB) ..... 0914629.1
Nov. 12, 2009 (GB) ..... 0919787.2

(51) Int. Cl.
*E21B 10/34* (2006.01)
*E21B 10/32* (2006.01)

(52) U.S. Cl.
CPC ..... *E21B 10/345* (2013.01); *E21B 10/322* (2013.01)

(58) Field of Classification Search
CPC ..... E21B 7/28; E21B 10/32; E21B 10/26; E21B 10/322; E21B 10/345; E21B 17/1057
USPC ..... 175/26, 27, 263, 265, 267, 284
See application file for complete search history.

(56) References Cited

U.S. PATENT DOCUMENTS

| | | | | |
|---|---|---|---|---|
| 2,169,502 | A | 8/1939 | Santiago | |
| 2,499,916 | A | 3/1950 | Ford | |
| 4,542,797 | A * | 9/1985 | Garrett | 175/228 |
| 4,561,508 | A * | 12/1985 | Garrett | 175/347 |
| 4,693,328 | A | 9/1987 | Furse et al. | |
| 4,792,000 | A * | 12/1988 | Perkin et al. | 175/228 |
| 5,139,098 | A * | 8/1992 | Blake | 175/269 |
| 5,788,000 | A * | 8/1998 | Maury et al. | 175/325.1 |
| 6,378,632 | B1 | 4/2002 | Dewey et al. | |
| 6,920,944 | B2 * | 7/2005 | Eppink et al. | 175/53 |
| 7,252,163 | B2 * | 8/2007 | Ollerenshaw et al. | 175/269 |
| 7,658,241 | B2 * | 2/2010 | Lassoie et al. | 175/57 |
| 2004/0134687 | A1 | 7/2004 | Radford et al. | |

FOREIGN PATENT DOCUMENTS

| | | |
|---|---|---|
| DE | 28 22 512 A1 | 12/1978 |
| EP | 1614852 A1 | 11/2006 |

(Continued)

*Primary Examiner* — Elizabeth Gitlin
(74) *Attorney, Agent, or Firm* — Kirton McConkie; Evan R. Witt

(57) ABSTRACT

An expandable downhole tool apparatus includes a body adapted to be incorporated into a drill string and at least one working member moveable relative to the body between an inward deactivated position and an outwardly deployed activated position in order to engage the wall of a borehole. An activation device moves at least one working member between the inward deactivated position and outwardly deployed activated position. At least one passage is formed through the body and extends from a location on the body adjacent at least one working member to a location remote from the respective working member to enable debris accumulating underneath the respective working member to move along the passage and exit the body.

19 Claims, 17 Drawing Sheets

(56) References Cited

FOREIGN PATENT DOCUMENTS

| | | | |
|---|---|---|---|
| GB | 2 313 860 | A | 12/1997 |
| GB | 2415453 | A | 12/2005 |
| GB | 2445862 | A | 7/2008 |
| WO | 95/13452 | A1 | 5/1995 |
| WO | 2005/021924 | A1 | 3/2005 |
| WO | 2006/079166 | A1 | 8/2006 |

* cited by examiner

EXPANDABLE DOWNHOLE TOOL APPARATUS

The present invention relates to an expandable downhole tool apparatus for incorporation into a drill string used in the oil and gas industry to drill boreholes, and relates particularly, but not exclusively to a drill string incorporating such an expandable downhole tool apparatus.

Drill strings are used in the oil and gas industry to cut boreholes to reach pockets of oil and gas. A drill string comprises lengths of drill elements which are interconnected to lengthen the drill string as the drill string advances down a borehole.

To meet demand for energy, the drilling of oil and gas wells is becoming more and more complex in order to open up new reserves. Wells are drilled from land directionally and wells are also drilled in deeper and deeper formations. This means that drill strings can stretch up to several kilometers in length and may be curved to facilitate directional drilling. However, longer, directional drill strings are susceptible to becoming stuck which can cause a catastrophic failure of the drill string. It is therefore desirable to provide drill string elements having expandable parts that are less susceptible to becoming jammed in outward positions.

U.S. Pat. No. 4,693,328 describes an expandable roller reamer in which rollers are pivotally mounted to the body of the apparatus by two levers. A piston is longitudinally moveable along the axis of the body and comprises a cam surface. When fluid pressure in the drill string is increased, the piston moves upwardly along the body and the cam surface pushes the rollers outwardly. This apparatus suffers from the drawback that there are a large number of components that are moveable relative to one another to enable the rollers to be expanded outwardly. Consequently, there is a greater likelihood that one of these moveable parts could malfunction and prevent the tool from operating correctly, particularly if debris from the drilled borehole becomes lodged in the moving parts of the tool. This therefore leads to a risk that the rollers could be jammed in the outward position which could prevent the drill string from being retrieved from the borehole and cause a catastrophic failure.

GB2445862 describes a downhole stabiliser having stabilisers that deploy along a direction which is offset from the radius of the body. This apparatus suffers from the drawback that debris from the drilled borehole could become lodged between the tool and the stabilisers preventing retraction of the stabilisers and causing the drill string to become stuck.

Preferred embodiments of the present invention seek to overcome the above disadvantages of the prior art.

According to the present invention, there is provided an expandable downhole tool apparatus for incorporation into a drill string, the apparatus comprising:

- a body adapted to be incorporated into a drill string;
- at least one working member moveable relative to the body between an inward deactivated position and an outwardly deployed activated position in order to engage the wall of a borehole;
- activation means adapted to move at least one said working member between the inward deactivated position and outwardly deployed activated position; and
- at least one passage formed through the body and extending from a location on the body adjacent at least one said working member to a location remote from the respective working member to enable debris accumulating underneath the respective working member to move along the passage and exit the body.

This provides the advantage of providing a means for preventing accumulation of debris underneath and in the moving parts of a working member of a drill string element. If the working members are prevented from retraction, this can increase the difficulty of withdrawing the drill string from a bore hole and in some circumstances, cause the drill string to become jammed in the bore hole which leads to a catastrophic drill string failure.

The passages enable debris accumulating under the working member to fall out or to be pushed through the passage so that the working members can fully retract.

In a preferred embodiment, the body defines a longitudinal axis and at least one said working member is moveable relative to the body in a radial direction, and wherein at least one said passage extends non-radially away from the respective working member to a point on the surface of the body.

It has been found that this configuration of passage leading from the working member, through the tool body, and exiting at a point on the surface of the body is particularly effective at preventing accumulation of debris under the working members. In this configuration, the centrifugal force of the rotating drill string assists in moving debris along the passages to exit the body.

The apparatus may further comprise first and second pistons mounted in the body and moveable relative to the body between an inward retracted position and outwardly deployed activated position in response to fluid pressure in the body acting on respective surfaces of the first and second pistons disposed internally in the body, wherein at least one said working member is mounted between said first and second pistons and wherein at least one said passage extends from a location underneath the respective working member.

This provides the advantage of a working member configuration that enables the passage to extend from directly below the working member to assist removal of debris, for example when the working member moves to the inward retracted position it can push debris down the passage. Furthermore, this configuration also enables the size of the passage to be maximised.

Passages enable use of a closer tolerance between the diameters of the piston and pocket in the body in which the piston sits because debris can move from under the piston along passage rather than back out past the piston.

The apparatus may further comprise a cutter element disposed on an end of said first and/or second piston, the cutter element arranged to cut into the side of the borehole when the respective piston is in the outwardly deployed activated position.

The apparatus may further comprise:

- a plurality of working members disposed around the body, wherein each said working member is moveable relative to the body between an inward deactivated position and an outwardly deployed activated position in order to engage the wall of a borehole; and
- a passage formed through the body for each said working member and extending from a location on the body adjacent the respective working member to a location remote from the respective working member to enable debris accumulating underneath the respective working member to move along the passage and exit the body;
- wherein each said working member and corresponding passage is disposed at a different location along a longitudinal axis of the body.

This provides the advantage that the passages formed in the body do not form a concentrated weak point on the body. Staggering the working members and passages along the axial length of the body does not detrimentally affect the working ability of the apparatus while minimising the weakness and likelihood of breakage due to the body having passages formed therein.

At least one said working member may be a roller arranged to roll against the side of a borehole when in the outwardly deployed activated position to provide stabilisation to and reduce vibration and torque in a drill string in which the apparatus is incorporated.

It has been found that using the passage configuration in an expandable roller bearing provides a highly effective expandable roller bearing for stabilising long drill strings. The passages facilitate cycling of the tool and repeated expansion and retraction of the working members.

The apparatus may further comprise crushing means disposed on an outer surface of at least one said roller and being arranged to crush rock when the respective roller rolls against the side of a borehole.

In very hard formations, polycrystalline diamond (PDC) cutter bits or diamond drag bits are not so effective to cut the formation and can quickly become damaged which causes drilling to stop. For these hard formations, it is generally necessary to employ insert roller cone rock bits that roll on the formation crushing the rock and not cutting the rock. Consequently, the apparatus can be used in combination with crushing means dispersed on the stabilising rollers to crush rock and enlarge the hole in a ream while drilling operation. The passages increase the efficiency of the crushing rollers because debris moves quickly away from the crushed part of the wall of the bore hole.

Said crushing means may comprise a plurality of hardened inserts disposed in the outer surface of at least one said roller.

Each said hardened insert may comprise a substantially dome shaped portion arranged to contact and crush rock.

The apparatus may further comprise a thread disposed on the outer surface of at least one said roller, the thread arranged to engage the sides of a borehole and push the apparatus down the borehole.

This provides the advantage of a stabiliser that also helps a drill string advance down a hole.

According to a further aspect of the present invention, there is provided a drill string comprising a plurality of drill string elements and at least one expandable downhole tool apparatus as defined above.

Preferred embodiments of the present invention will now be described, by way of example only, and not in any limitative sense with reference to the accompanying drawings in which.

Figure 4:
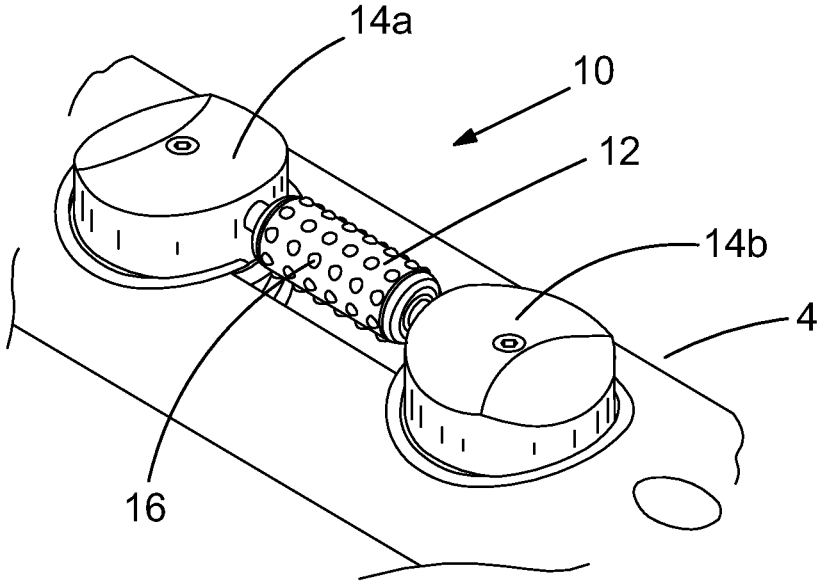
FIG. 4 is a close-up view of the roller assembly in the condition shown in FIG. 2.
Figure 6A:
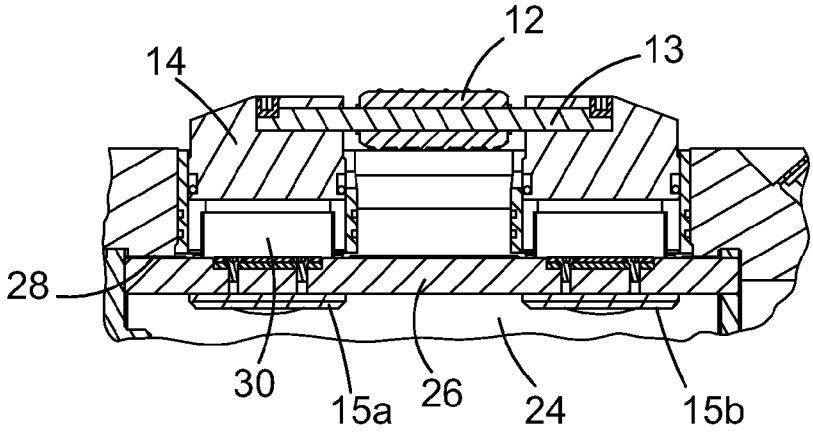
Figure 6B:
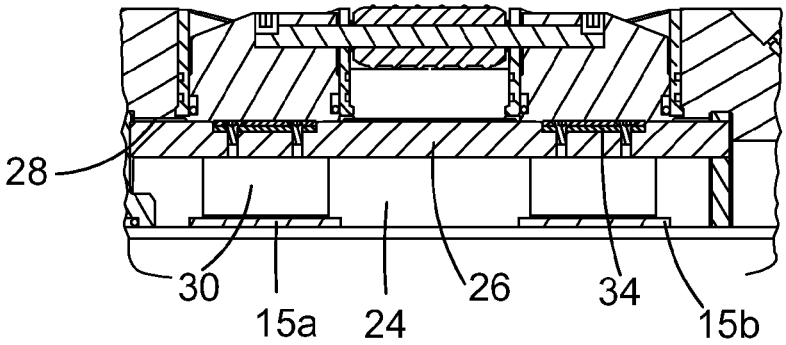
Figure 7A:
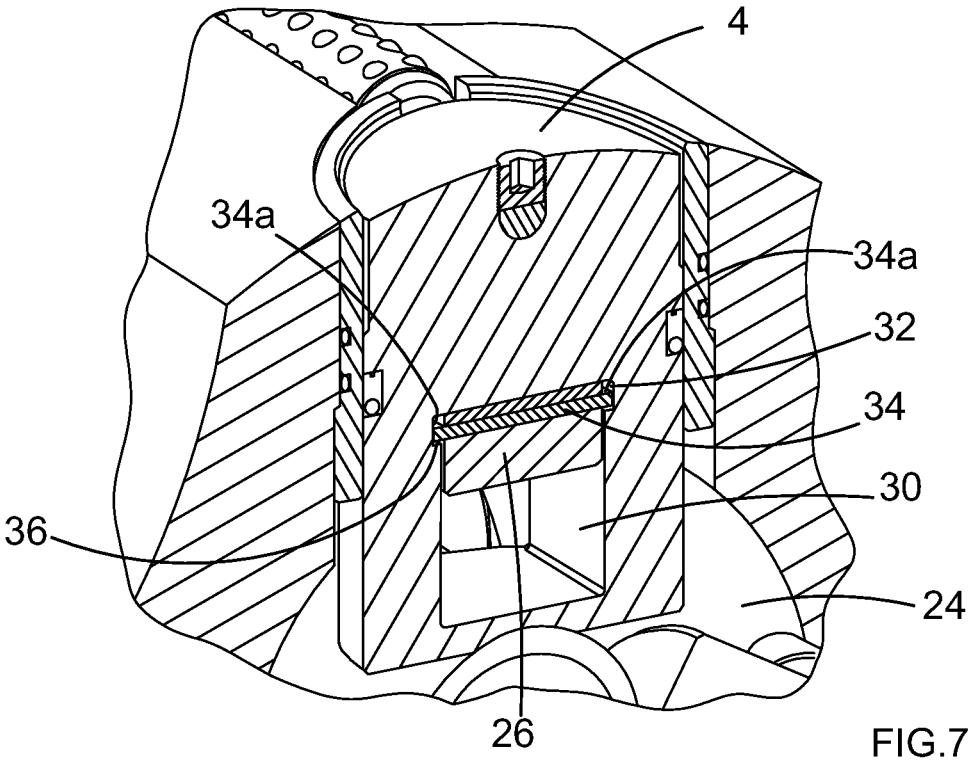
Figure 7B:
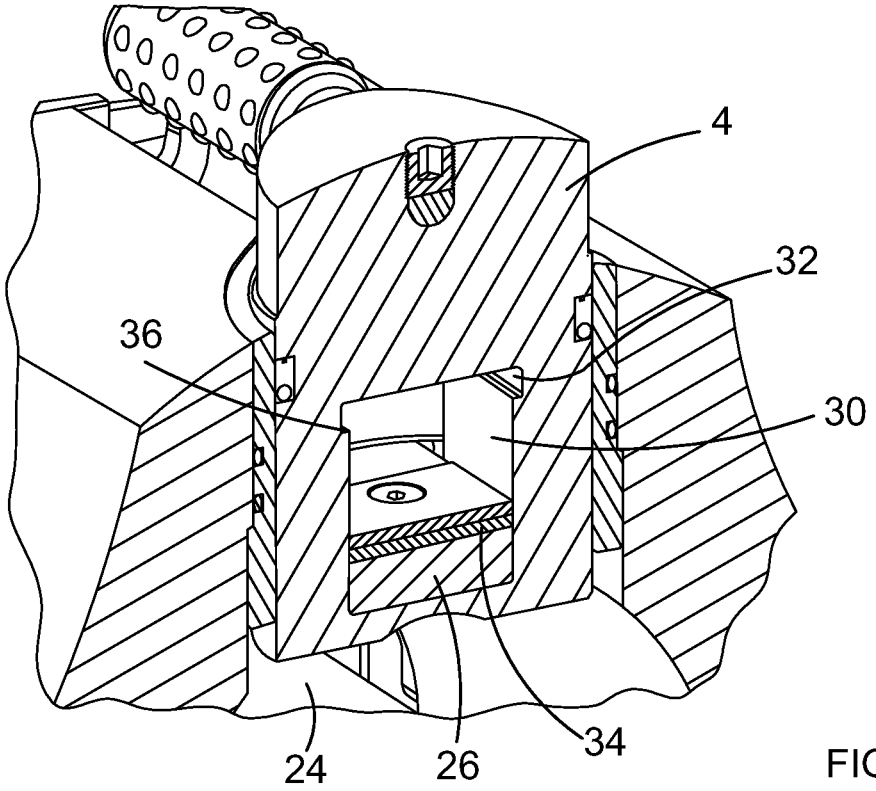
Figure 8A:
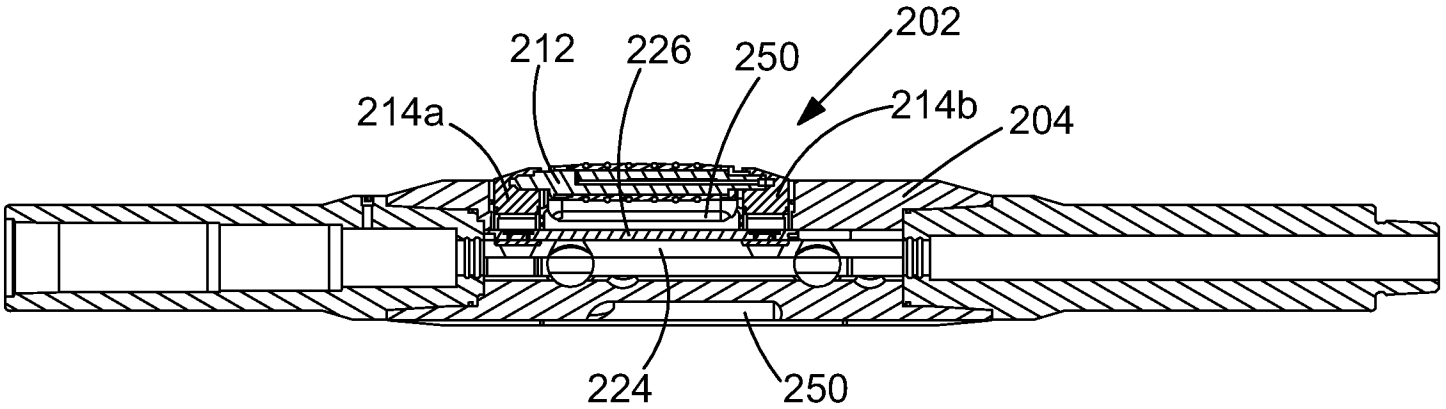
Figure 8B:
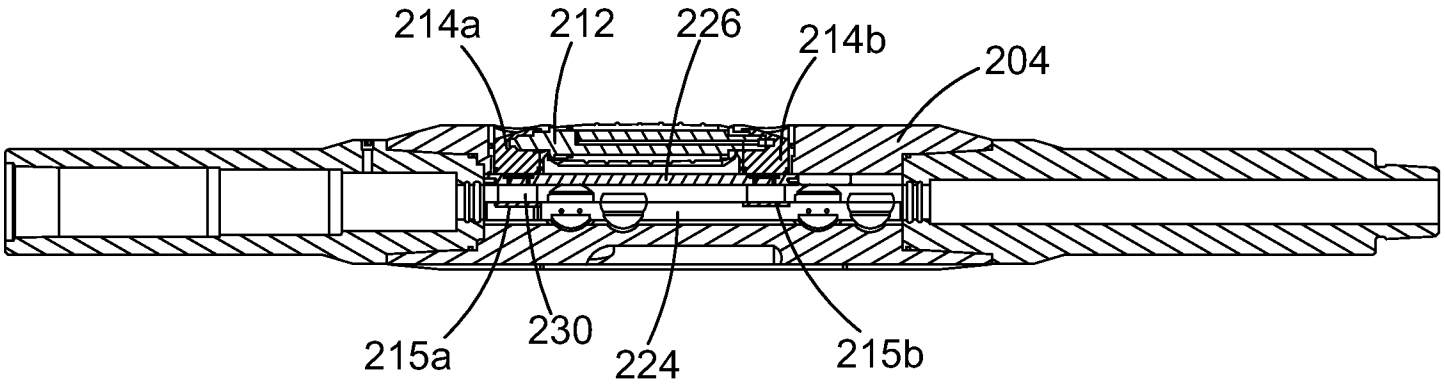
Figure 8C:
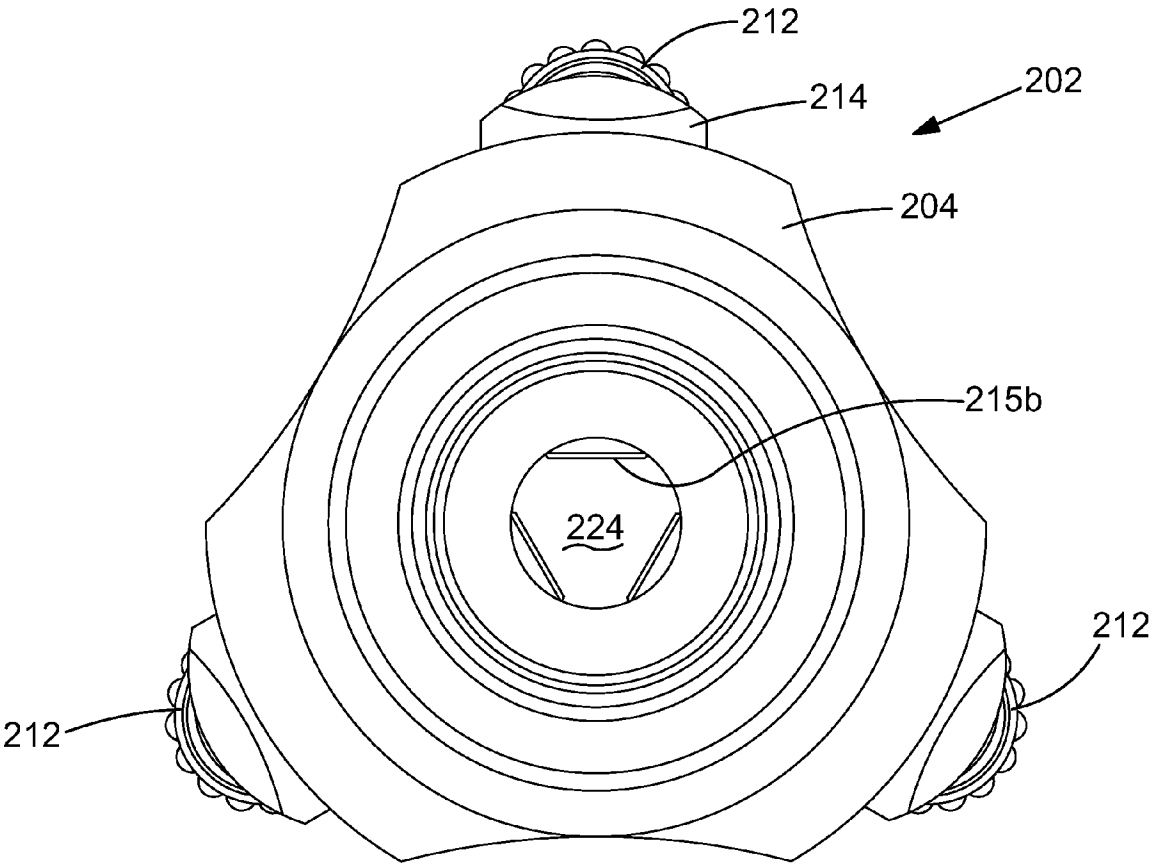

FIG. 6*a* is a cross-sectional view showing a roller assembly in the outwardly deployed activated position as shown in FIG. 4;

FIG. 6*b* is a cross-sectional view corresponding to FIG. 6*a* showing the roller assembly in the inwardly retracted position;

FIG. 7*a* is a cross-sectional view of a piston in the inwardly retracted position showing the retaining member and shearable plate in the unsheared condition;

FIG. 7*b* is a view corresponding to FIG. 7*a* showing the shearable plate in the sheared condition and the piston in the outwardly deployed activating position;

FIG. 8*a* is a longitudinal cross section of a downhole expandable roller bearing apparatus embodying the present invention showing the pistons in the outwardly deployed activated position;

FIG. 8*b* is a longitudinal cross section of the downhole expandable roller bearing apparatus of FIG. 8*a* showing the pistons in the inwardly retracted position;

FIG. 8*c* is an end view of the apparatus of FIG. 8*a;*

Figure 8D:
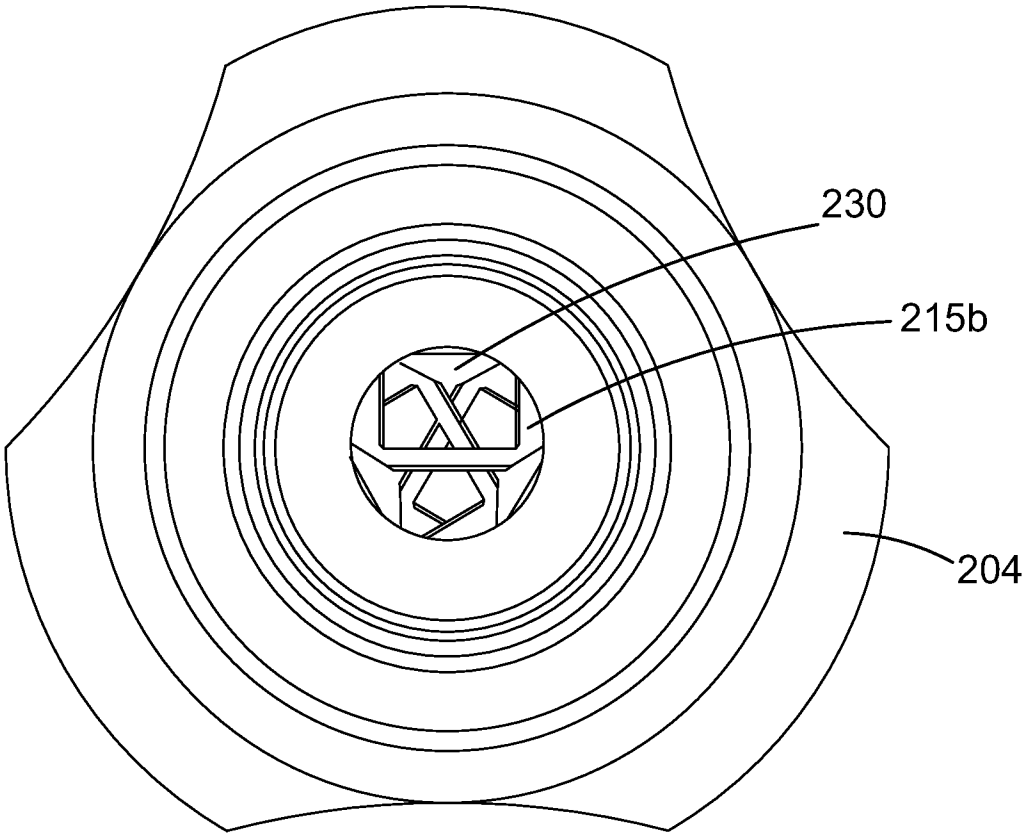

FIG. 8*d* is an end view of the apparatus of FIG. 8*b;*

Figure 9:
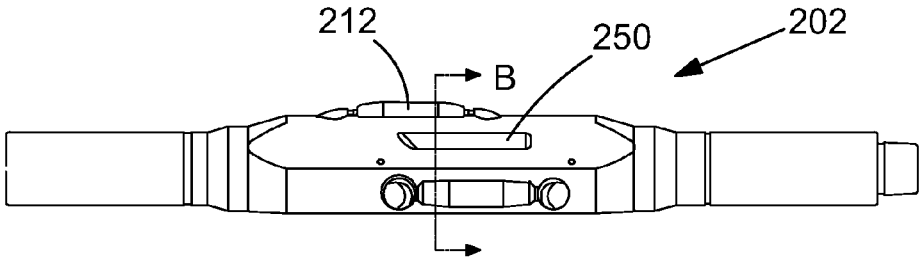

FIG. 9 is a side view of an expandable downhole tool apparatus of FIGS. 8*a* to 8*d;*

Figure 10:
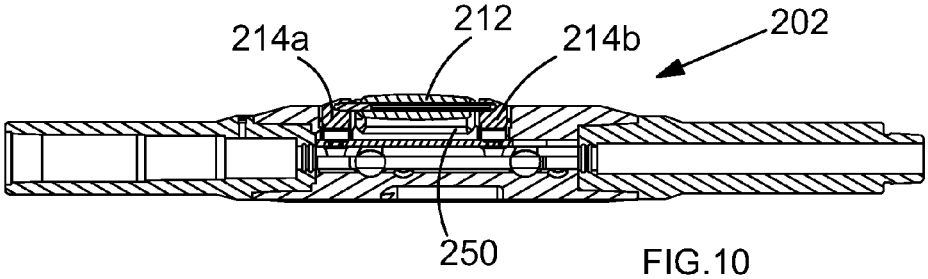
Figure 11:
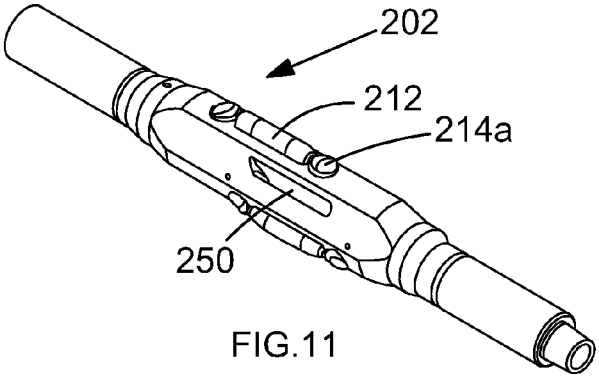
Figure 12:
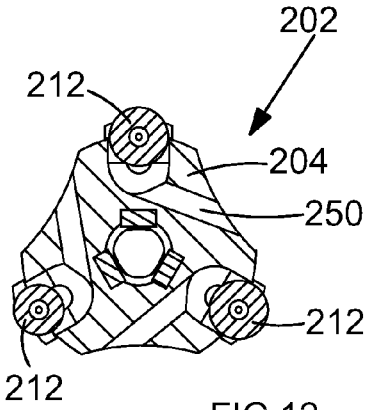
Figure 13:
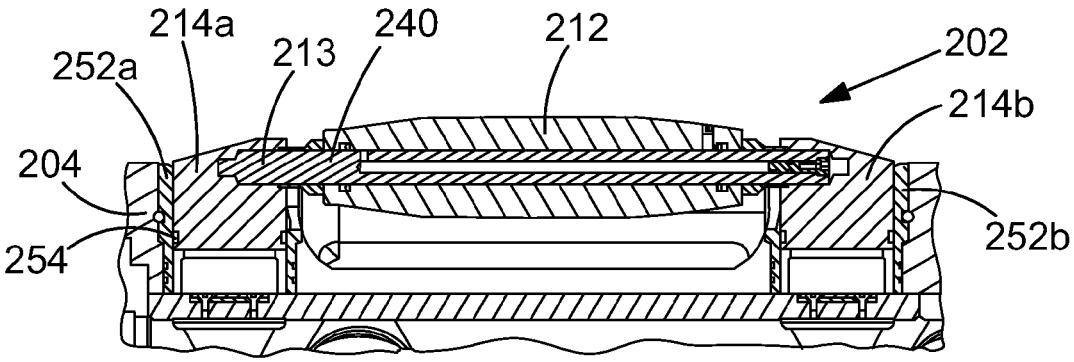
Figure 14:
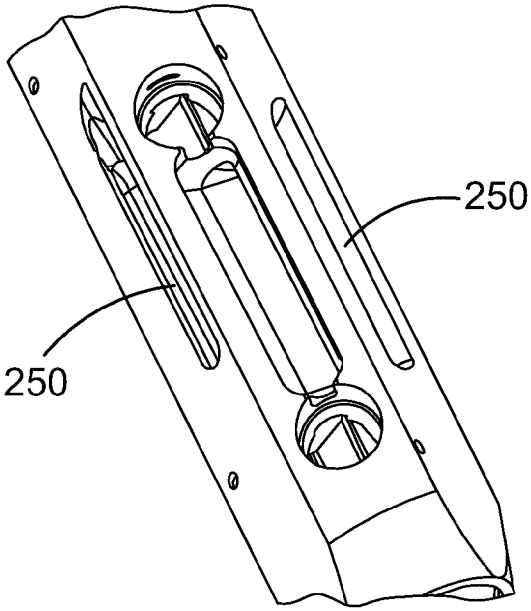
Figure 15:
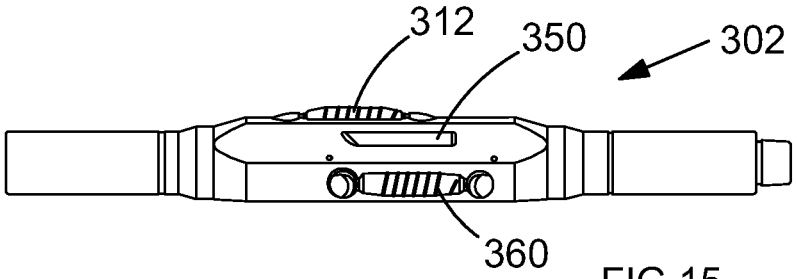
Figure 16:
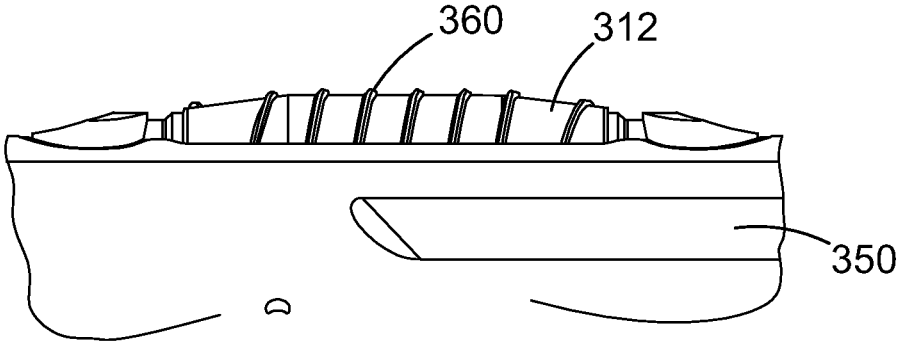
Figure 17:
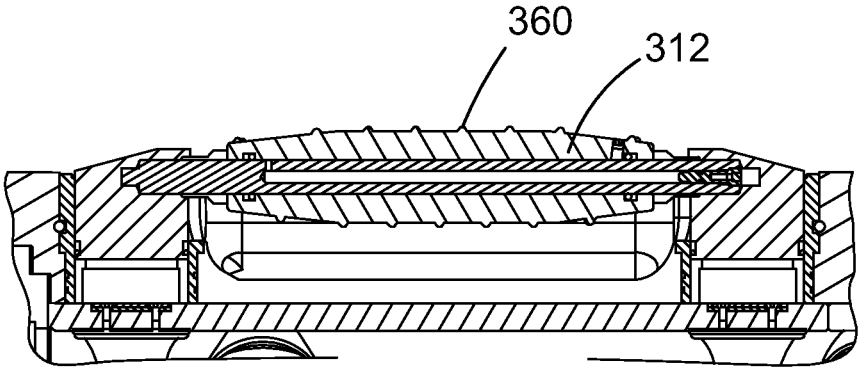
Figure 18:
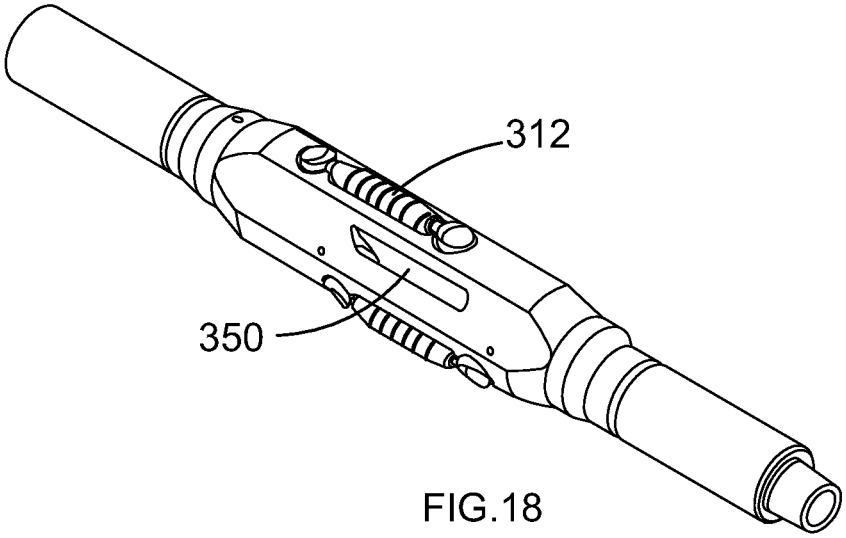
Figure 19:
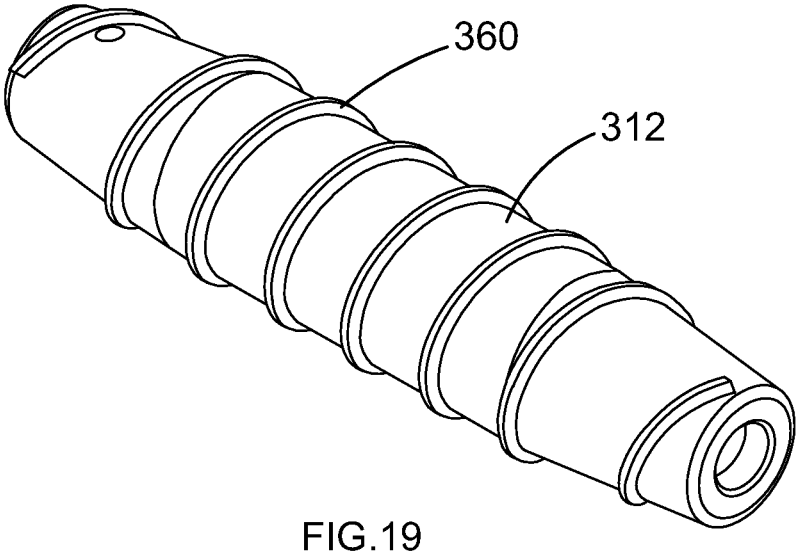
Figure 20:
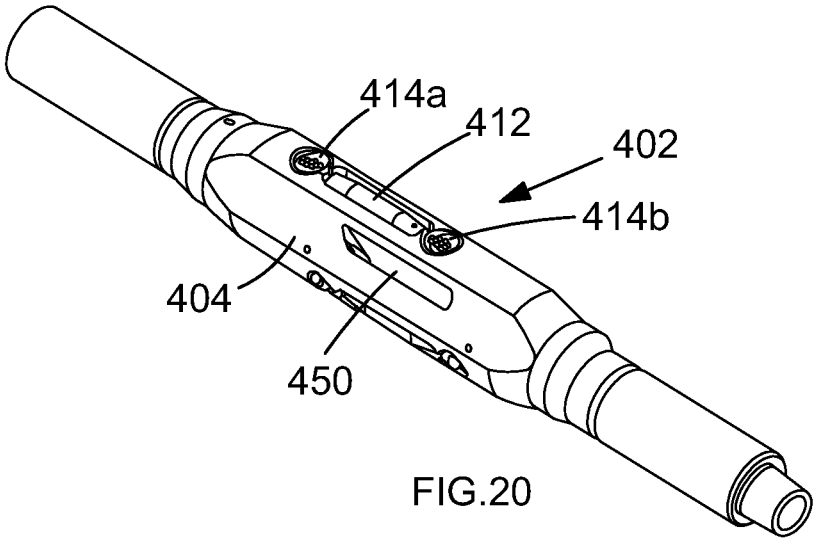
Figure 21:
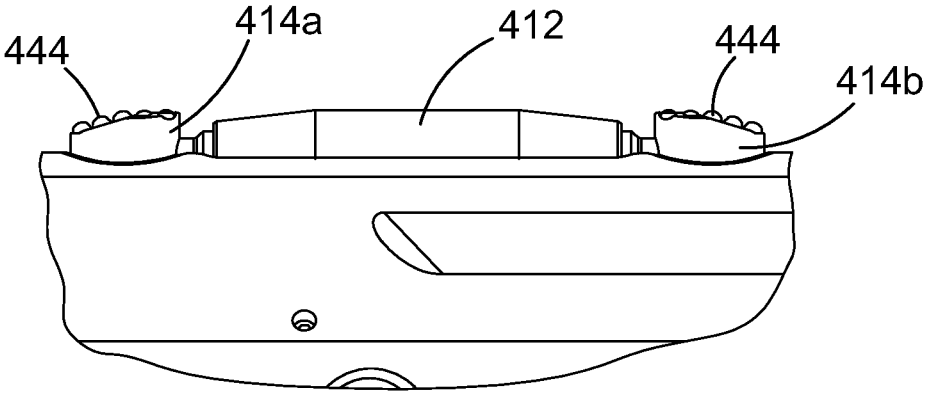
Figure 22:
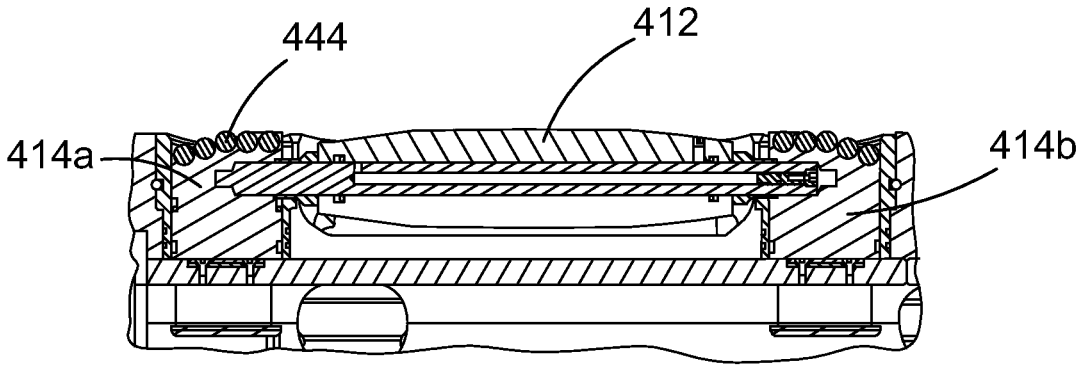
Figure 23:
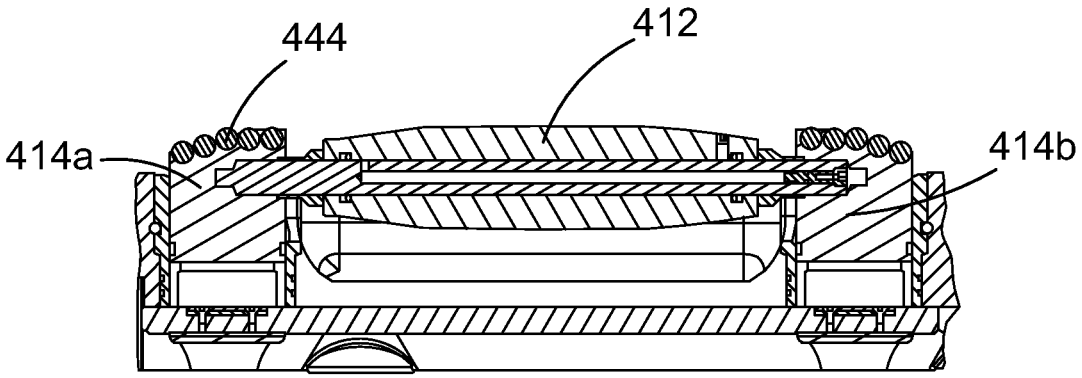
Figure 24:
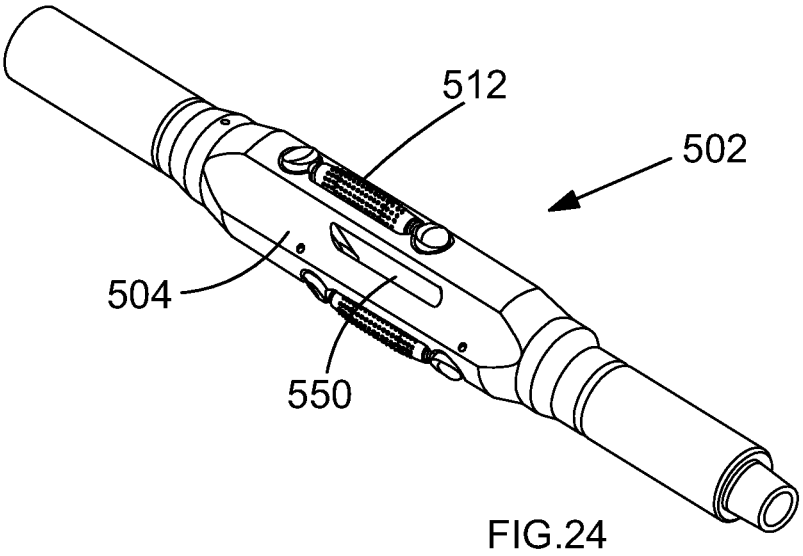
Figure 25:
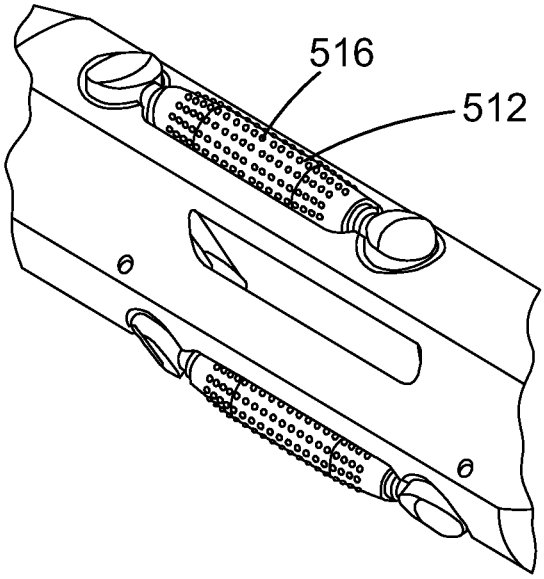
Figure 26:
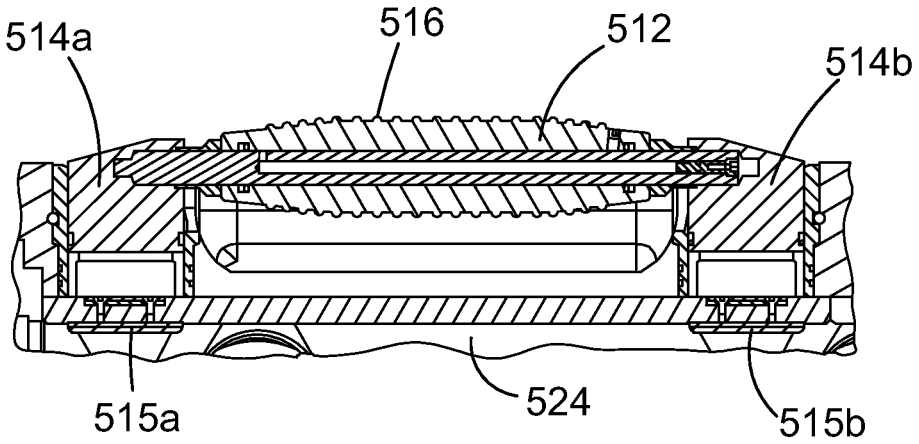
Figure 27:
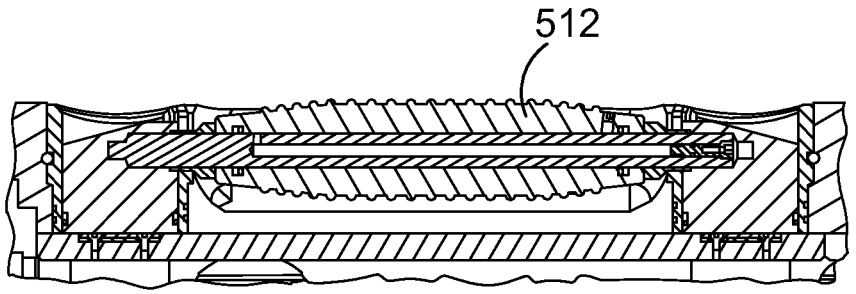
Figure 28:
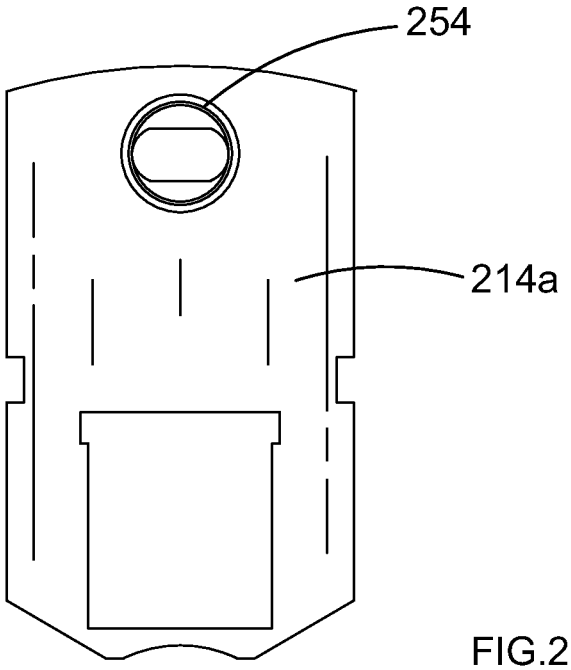
Figure 29:
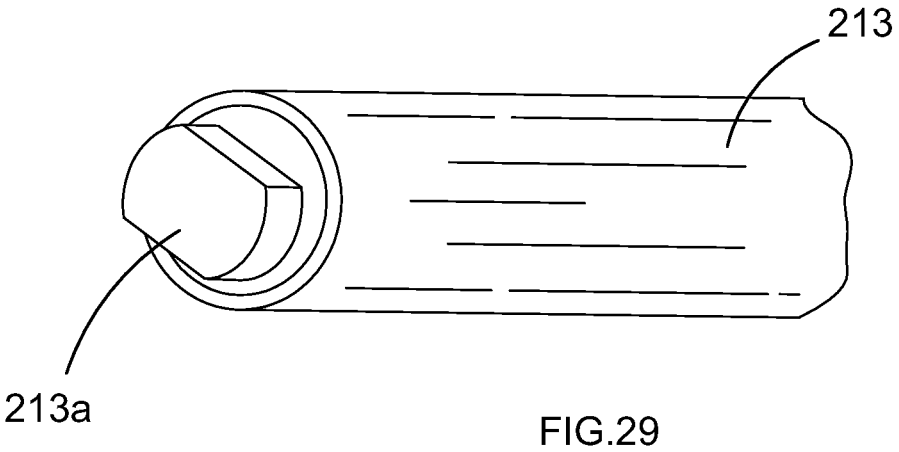

FIG. 10 is a cross-sectional view corresponding to FIG. 9;

FIG. 11 is a perspective view corresponding to FIG. 9;

FIG. 12 is an axial cross-sectional view taken along line B-B of FIG. 9;

FIG. 13 is a close-up longitudinal cross-sectional view of a roller and passage of FIG. 9;

FIG. 14 is a perspective view of a portion of the apparatus of FIG. 9 showing the pistons and roller removed from the body;

FIG. 15 is a side view of a downhole expandable roller bearing apparatus of a second embodiment of the present invention;

FIG. 16 is a close-up side view of the pistons and roller of FIG. 15;

FIG. 17 is a longitudinal cross-sectional view of FIG. 16;

FIG. 18 is a perspective view corresponding to FIG. 15;

FIG. 19 is a perspective view of a threaded roller of the embodiment of FIG. 15;

FIG. 20 is a perspective view of a downhole expandable roller bearing apparatus of a third embodiment of the present invention;

FIG. 21 is a close-up side view of a roller and pistons on which cutters are mounted corresponding to FIG. 20;

FIG. 22 is a longitudinal cross-sectional view of the pistons and roller of FIGS. 20 and 21 in the inwardly retracted position;

FIG. 23 is a cross-sectional view corresponding to FIG. 22 showing the pistons and roller in the outwardly deployed activated position;

FIG. 24 is a perspective view of a downhole expandable roller bearing apparatus of a fourth embodiment of the present invention;

FIG. 25 is a close-up view of the rollers and passages of FIG. 24;

FIG. 26 is a close-up longitudinal cross-section of pistons and a roller of FIGS. 24 and 25 in the outwardly deployed activated position;

FIG. 27 is a view corresponding to FIG. 26 showing the pistons and roller in the inwardly retracted position;

FIG. 28 is a side view of a piston having a coating of a hardened material; and FIG. 29 is perspective view of part of an axle having a coating of hardened material.

Referring to FIGS. 1 to 4, an expandable downhole tool apparatus 2 comprises a body 4 having longitudinal axis X and being adapted to be incorporated into a drill string, at least one working member 10 moveable relative to the body between an inward deactivated position (FIG. 1) and an outwardly deployed activated position (FIG. 2) in order to engage the wall of a borehole.

Expandable downhole tool apparatus 2 is mounted between a top sub 6 and a bottom sub 8. The apparatus 2 is adapted to be incorporated into a drill string comprising a drill bit (not shown) for use drilling well bores in the oil and gas industry as will be familiar to persons skilled in the art.

Figure 3:
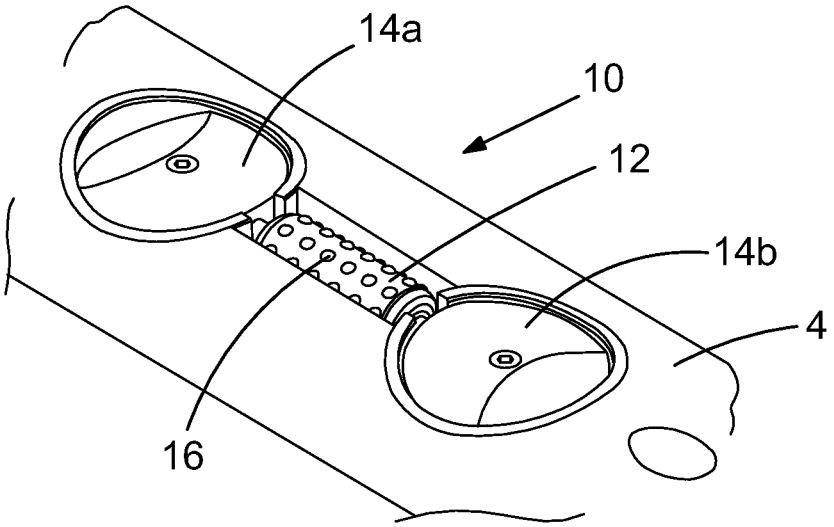
FIG. 3 is a close-up of a roller assembly comprising roller and pistons in the condition shown in FIG. 1.

Referring to FIGS. 3 and 4, the apparatus 2 comprises a plurality of working members 10 which in the example shown comprise at least one roller 12. Roller 12 enables the apparatus 2 to act as an expandable roller bearing to provide stabilisation to a drill string, particularly in ream while drilling operations. Alternatively, the working member could be an under reamer bit adapted to enlarge a borehole when in the outwardly deployed activated position.

Roller 12 is rotatably mounted between pistons 14*a* and 14*b*. Alternatively, roller 12 could be mounted to a single larger piston having two bushings between which the roller is mounted. Pistons 14*a*, 14*b* are arranged to be moveable relative to the body 4 between an inwardly retracted position (FIG. 3) and an outwardly deployed activated position (FIG. 4) in which the roller 12 is arranged to engage the sides of a borehole. Consequently, when a drill string is performing a ream while drilling operation to expand a borehole, the rollers can be deployed to engage the sides of the borehole to stabilise the drill string and prevent torque and vibration in the drill string.

Figure 1:
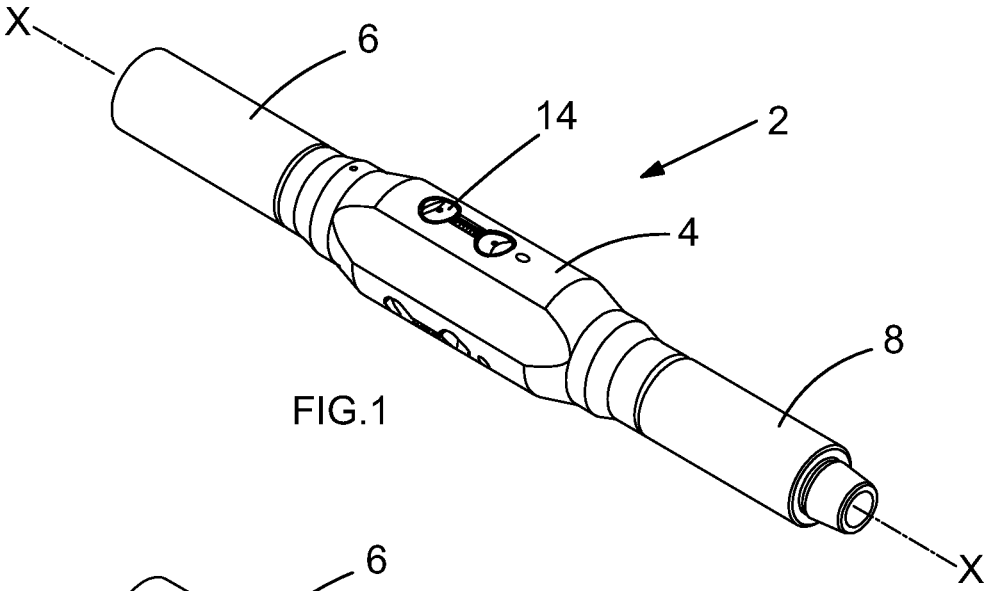
FIG. 1 is a perspective view of an expandable downhole tool apparatus showing working members in the inwardly retracted position.
Figure 2:
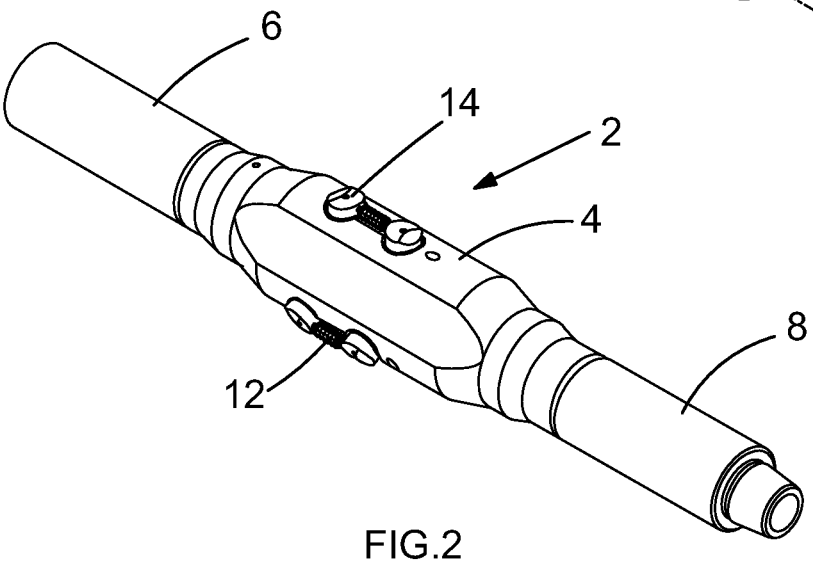
FIG. 2 is a perspective view corresponding to FIG. 1 showing working members in the outwardly deployed activated position.

Roller 12 comprises crushing means such as a plurality of hardened inserts 16. As shown in FIGS. 1 and 2, the apparatus 2 is generally rotationally symmetrical with three working members 10 arranged at 120° intervals around the body.

Figure 5:
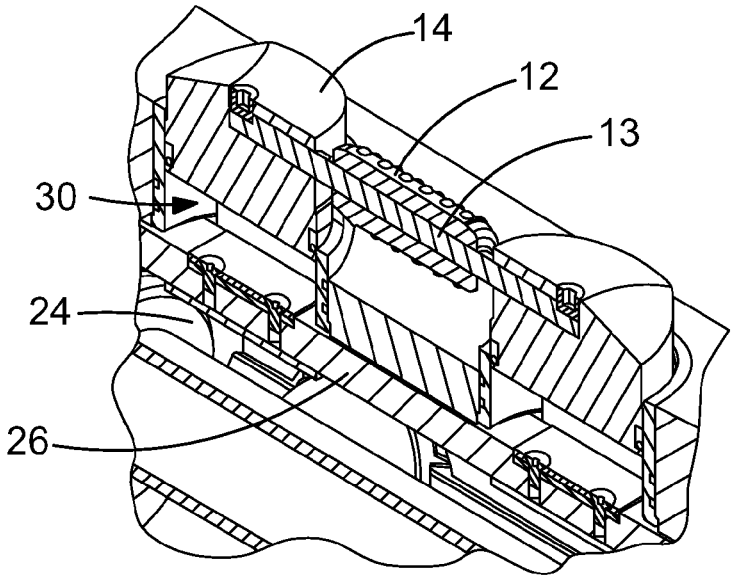
FIG. 5 is a cross-sectional perspective view of the apparatus showing a roller assembly in the condition of FIGS. 2 and 4.

Referring to FIGS. 5 to 7, apparatus 2 is generally hollow and comprises activation means adapted to move at least one said working member 10 between the inward deactivated position and outwardly deployed activated position. In the example shown, the activation means comprises a piston chamber 24. Fluid is able to flow freely through the tool and the fluid pressure can be controlled from the surface when the apparatus 2 is mounted in a drill string. The fluid pressure in piston chamber 24 can therefore be increased to cause a pressure differential between the piston chamber 24 and the outside of the tool. Once a predetermined pressure differential is achieved, fluid pressure acting directly on internal surfaces 15*a* and 15*b* of the first and second pistons 14*a* and 14*b* respectively moves pistons 14*a* and 14*b* into the outwardly deployed activated positions as shown in FIGS. 2, 4, 5 and 6*a*. This deploys roller 12 outwardly.

The pistons 14*a* and 14*b* move inwardly and outwardly in a radial direction relative to longitudinal axis X (FIG. 1). This enables the pistons to pass through the centre line of the body to increase the stroke of the pistons to enable rollers 12 to engage the sides of a previously enlarged borehole.

As a consequence of fluid pressure acting directly on internal surfaces 15*a* and 15*b* of the first and second pistons 14*a* and 14*b*, the pistons have a greater range of travel than prior art expandable downhole tools. This is because longitudinally moveable cam arrangements (such as in U.S. Pat. No. 4,693,328) are not required to force the rollers out by frictional contact. The space taken up by these components in the tool is therefore saved and can be used to accommodate longer piston stroke.

Each piston 14 comprises an aperture 30 formed through the body of the piston. This is best shown in FIGS. 5, 7*a* and 7*b*. The aperture 30 defines an aperture axis that is perpendicular to the radius of the body 4 (the direction along which the pistons move) when the piston is mounted in body 4.

A retaining member 26 is removably mountable in the body to project into the respective aperture 30 in both the inwardly retracted and outwardly deployed activated positions of the pistons. Retaining member 26 therefore prevents removal of the corresponding piston 14 from the body and resists rotation of the piston 14 relative to the body. The retaining member 26 defines a retaining member axis that is parallel to the longitudinal axis of the body when mounted in the body. Also, as shown in FIGS. 5 and 6, the retaining member 26 projects into a plurality of apertures 30 to hold a plurality of pistons 14 in the body.

Use of retaining member 26 rather than a pin to hold the piston 14 in body 4 significantly increases the strength of the assembly. This helps to prevent removal of the piston 14 from body 4 and prevents rotation of the piston 14.

Referring to FIGS. 5 to 7, the retaining member may be a spline bar 26 which is removably mounted in a keyway 28 formed in the body 4. Each piston 14 comprises an aperture 30 through which the spline bar 26 projects in both the inwardly retracted and outwardly deployed positions of the piston 14.

Referring to FIGS. 7*a* and 7*b*, each aperture 30 comprises a slot 32 arranged adjacent the aperture. A shearable plate 34 is interconnected with the spline bar 26 by means of screws or the like. Shearable plate 34 comprises end portions or tabs 34*a* which sit in the edges of slot 32 and engage a shoulder portion 36 formed between the slot 32 and aperture 30. In the inwardly retracted position of the piston as shown in FIG. 7*a*, shearable plate 34 prevents shoulder 36 of the piston 4 moving upwardly and into the outwardly deployed position. However, when the pressure in piston chamber 24 reaches a certain threshold, the pressure differential between the inside of the tool in piston chamber 24 and the outside of the tool overcomes the strength of tabs 34*a* which break off from the shearable plate 34. This enables the piston 14 to move into the outwardly deployed activated position as shown in FIG. 7*b*. All of these parts are easily replaceable which facilitates maintenance and reuse of the apparatus 2.

Alternatively, the plate 34 may mountable to the spline bar 26 by at least one shearable pin (not shown). The shearable pin may be adapted to break in response to an increase in fluid pressure in the body in order to enable the piston 14 to move to the outwardly deployed activated position.

Roller 12 is mounted on an axle 13. Once pressure is removed from piston chamber 24, the rollers 12 are pushed inwardly by reaction with the formation through which the drill string is moving. This enables easy retraction of rollers 12.

An expandable downhole tool apparatus embodying the present invention is shown in FIGS. 8 to 14 with parts common to the apparatus of FIGS. 1 to 7 denoted by like reference numerals but increased by 200.

Expandable downhole tool apparatus 202 comprises a body 204 adapted to be incorporated into a drill string and at least one working member 210 moveable relative to the body between an inward deactivated position and an outwardly deployed activated position in order to engage the wall of a borehole. Activation means adapted to move at least one said working member between the inward deactivated position and outwardly deployed activated position is provided. The activation means is the same as that described above in connection with the apparatus of FIGS. 1 to 8. At least one passage 250 is formed through the body and extends from a location on the body adjacent at least one working member 210 to a location remote from the respective working member to enable debris accumulating underneath the respective working member to move along the passage and exit the body.

The apparatus 202 comprises three working members 210 in the form of rollers 212 rotatably mounted between respective pistons 214*a* and 214*b*. Alternatively, working members 210 can be under reamer bits for enlarging a borehole. Each piston 214*a*, 214*b* is disposed at a different location along the longitudinal axis of the body. This provides the advantage of increasing piston travel length. Since all of the pistons are located at different positions along the body, the internal ends of the pistons will not contact each other when retracted into the body. This is best shown in FIG. 8*d*. The pistons can therefore be made longer.

Pistons 214*a*, 214*b* are deployed by an increase in fluid pressure in piston chamber 224 acting on internal piston surfaces 215*a* and 215*b* of the pistons. Pistons are held in the body by retaining member 226 projecting through piston aperture 230. It can be seen from FIG. 8*a* that pistons 214*a*, 214*b* and rollers 212 only retract to an extent such that half or less the full diameter of roller 212 projects from body 204. In comparison, rollers 12 in FIGS. 2 and 4 project outwardly to a greater extent. This helps prevent debris lodging under the rollers 212 and enables the pockets that the rollers fit into to have a closer tolerance. This assists stabilisation of the roller 212 in the body 214.

Also, since the rollers 212 only project out to half diameter, if the rollers encounter obstacles or impacts from large rocks they will tend to be pushed back into body 204 against the pressure of fluid in piston chamber 224. The extent to which the rollers 212 project outwardly from body 204 can be changed merely by altering the width of retaining member 226.

Each roller 212 comprises an associated passage 250 which as can been seen from FIG. 19 extends to a location in the body underneath the roller 212 and exits the body at a location remote from underneath the piston 212. Passages 250 enable use of a closer tolerance between the diameters of the piston 214 and pocket in the body in which the piston sits because debris can move from under the piston along passage 250 rather than back out past the piston. This enables debris accumulating underneath the rollers to move along the passage and exit the body. Each passage 250 extends non-radially away from the respective working member to a point on the surface of the body. This is best shown in FIG. 12.

Since the passages 250, which are milled in the body 204 form weak points, the rollers 212 and passages 250 are formed at different locations along the longitudinal axis of the body to prevent a concentrated weak point as best shown in FIGS. 16 and 18.

Referring to FIG. 20, the pistons 214*a* and 214*b* are slidably mounted in bushings 252*a*, 252*b* which are press-fit in the body 204. The hardened bushings 252*a* and 252*b* are formed from a hardened material such as tungsten carbide or a hardened steel such as D2. Seals 254 prevent drilling fluid in the body passing pistons 214*a* and 214*b*.

Referring to FIGS. 35 and 36, piston 214*a* and axle 213 may also comprise a coating of hardened material such as tungsten carbide. Only an annular portion (not shown) of the piston may be coated. In this case, seals 254 would not be required because of the close tolerance between two sliding tungsten carbide surfaces.

Alternatively, the pistons and axle may be case hardened by nitriding or carburization or a combination of both. A hardened bushing 254 is disposed on piston 214*a* to receive end 213*a* of the axle 213. The hardened bushing 254 may be formed from a hardened material such as tungsten carbide or D2. By using these hardened materials, the lifespan of the roller bearing apparatus can be lengthened.

An expandable downhole tool of a second embodiment of the invention is shown in FIGS. 15 to 19, with parts common to the apparatus of FIGS. 1 to 8 denoted by like reference numerals but increased by 300.

Expandable downhole tool apparatus 302 comprises rollers 312 and passages 350 in common with the embodiment of FIG. 16 to 21. However, rollers 312 comprise a screw thread 360. The thread 360 is arranged in an anti-clockwise direction such that if the drill string is rotating in a clockwise direction, the rollers rotate approximately 5 times faster than the main drill string. The thread is therefore arranged to bite into the formation and push the drill string downwardly to help the advance of the drill string. Consequently, this embodiment is used as both a stabiliser to reduce vibration and torque in a drill string and also helps to push the drill string downwardly.

An expandable downhole tool of a third embodiment of the invention is shown in FIGS. 20 to 23, with parts common to the apparatus of FIGS. 1 to 8 denoted by like reference numerals but increased by 400.

Expandable downhole tool apparatus 402 comprises rollers 412 disposed between pistons 414*a* and 414*b*. Passages 450 are formed in the body 404. A cutter element 444 is disposed on the end of each piston 414. The cutter elements 444 may be formed from polycrystalline diamond (PDC) or may comprise tungsten carbide inserts. Consequently, this embodiment can be used as a combined stabiliser and underreamer.

An expandable downhole tool of a fourth embodiment of the invention is shown in FIGS. 24 to 27 with parts common to the apparatus of FIGS. 1 to 8 denoted by like reference numerals but increased by 500.

This embodiment is a combination of rollers having crushing means and also windows formed underneath the rollers to prevent accumulation of debris under the rollers. Apparatus 502 comprises rollers 512 on which crushing means are disposed. The crushing means may for example comprise a plurality of hardened inserts or buttons 516. Hardened inserts may be formed from tungsten carbide. Windows 550 are formed through the body 504. When the drill string is advancing downhole in a particularly hard formation, the rollers can be used to crush rock. For example, with PDC or tungsten carbide inserts 516 having a domed shaped configuration being inserted in the rollers, the formation can be enlarged.

For example, if the internal surfaces 515*a*, 515*b* of pistons 514*a* and 514*b* have an area of 10 square inches each, and the pressure differential between piston chamber 524 and the outside of the apparatus is 1000 psi, 20,000 pounds of force will be applied to each of the three rollers around the apparatus. This is sufficient force to crush hard rock formations with hardened roller inserts. In this embodiment, hardened bushings axles and pistons would be used as shown in FIGS. 35 and 36.

It will be appreciated by person skilled in the art that the above embodiments have been described by way of example only and not in any limitative sense, and that various alterations and modifications are possible without departure from the scope of the invention as defined by the appended claims. In particular, features of the embodiments described above can be interchanged, such as different combinations of cutters, rollers, passages, hardened roller inserts and hardened components. Also, the rollers could be solid in construction and rotatably mounted to the pistons directly rather than being mounted on a non-rotatable axle. Furthermore, a roller could be rotatably mounted to a single piston, rather than being rotatably mounted between two pistons, such that only a single piston having two bushings for example is provided for each roller assembly.

The invention claimed is:

1. An expandable downhole tool apparatus for incorporation into a drill string, the apparatus comprising:

a body adapted to be incorporated into a drill string;

at least one working member moveable relative to the body between an inward deactivated position and an outwardly deployed activated position in order to engage the wall of a borehole;

activation means adapted to move at least one said working member between the inward deactivated position and outwardly deployed activated position; and at least one passage formed through a wall of the body and extending from a first opening on the body underneath at least one said working member to a second opening on an outer surface of the body remote from the respective working member to enable debris accumulating underneath the respective working member to move along the passage and exit the body.

2. An apparatus according to claim 1, wherein the body defines a longitudinal axis and at least one said working member is moveable relative to the body in a radial direction, and wherein at least one said passage extends non-radially away from the respective working member to the second opening on the outer surface of the body.

3. An apparatus according to claim 2, further comprising first and second pistons mounted in the body and moveable relative to the body between an inward retracted position and outwardly deployed activated position in response to fluid pressure in the body acting on respective surfaces of the first and second pistons disposed internally in the body, wherein at least one said working member is mounted between said first and second pistons and wherein at least one said passage extends from the first opening at a location underneath the respective working member.

4. An apparatus according to claim 3, further comprising a cutter element disposed on an end of at least one of the first and second piston, the cutter element arranged to cut into the side of a borehole when the respective piston is in the outwardly deployed activated position.

5. An apparatus according to claim 4, further comprising:

a plurality of working members disposed around the body, wherein each said working member is moveable relative to the body between an inward deactivated position and an outwardly deployed activated position in order to engage the wall of a borehole; and a passage formed through the body wall for each said working member and extending from a location on the body underneath the respective working member to a location remote from the respective working member on the outer surface of the body to enable debris accumulating underneath the respective working member to move along the passage and exit the body;

wherein each said working member and corresponding passage is disposed at a different location along a longitudinal axis of the body.

6. An apparatus according to claim 5, wherein at least one said working member is a roller arranged to roll against the side of a borehole when in the outwardly deployed activated position to provide stabilisation to and reduce vibration and torque in a drill string in which the apparatus is incorporated.

7. An apparatus according to claim 6, further comprising crushing means disposed on an outer surface of at least one said roller and being arranged to crush rock when the respective roller rolls against the side of a borehole.

8. An apparatus according to claim 7, wherein said crushing means comprises a plurality of hardened inserts disposed in the outer surface of at least one said roller.

9. An apparatus according to claim 8, wherein each said hardened insert comprises a substantially dome shaped portion arranged to contact and crush rock.

10. An apparatus according to claim 6, further comprising a thread disposed on the outer surface of at least one said roller, the thread arranged to engage the sides of a borehole and push the apparatus down the borehole.

11. An apparatus according to claim 1, further comprising first and second pistons mounted in the body and moveable relative to the body between an inward retracted position and outwardly deployed activated position in response to fluid pressure in the body acting on respective surfaces of the first and second pistons disposed internally in the body, wherein at least one said working member is mounted between said first and second pistons and wherein at least one said passage extends from the first opening at a location underneath the respective working member.

12. An apparatus according to claim 11, further comprising a cutter element disposed on an end of at least one of the first and second piston, the cutter element arranged to cut into the side of a borehole when the respective piston is in the outwardly deployed activated position.

13. An apparatus according to claim 1, further comprising:

a plurality of working members disposed around the body, wherein each said working member is moveable relative to the body between an inward deactivated position and an outwardly deployed activated position in order to engage the wall of a borehole; and a passage formed through the body wall for each said working member and extending from a location on the body underneath the respective working member to a location remote from the respective working member on the outer surface of the body to enable debris accumulating underneath the respective working member to move along the passage and exit the body;

wherein each said working member and corresponding passage is disposed at a different location along a longitudinal axis of the body.

14. An apparatus according to claim 1, wherein at least one said working member is a roller arranged to roll against the side of a borehole when in the outwardly deployed activated position to provide stabilisation to and reduce vibration and torque in a drill string in which the apparatus is incorporated.

15. An apparatus according to claim 14, further comprising crushing means disposed on an outer surface of at least one said roller and being arranged to crush rock when the respective roller rolls against the side of a borehole.

16. An apparatus according to claim 15, wherein said crushing means comprises a plurality of hardened inserts disposed in the outer surface of at least one said roller.

17. An apparatus according to claim 16, wherein each said hardened insert comprises a substantially dome shaped portion arranged to contact and crush rock.

18. An apparatus according to claim 14, further comprising a thread disposed on the outer surface of at least one said roller, the thread arranged to engage the sides of a borehole and push the apparatus down the borehole.

19. A drill string comprising a plurality of drill string elements and at least one expandable downhole tool apparatus according to claim 1.

* * * * *